US011905612B2

(12) United States Patent
Naito et al.

(10) Patent No.: US 11,905,612 B2
(45) Date of Patent: Feb. 20, 2024

(54) METHOD FOR PLATING OF TUBULAR WORKPIECE

(71) Applicant: JAPAN AVIATION ELECTRONICS INDUSTRY, LIMITED, Tokyo (JP)

(72) Inventors: Takeharu Naito, Tokyo (JP); Osamu Hashiguchi, Tokyo (JP); Yumiko Kobori, Tokyo (JP); Akifumi Nakamura, Tokyo (JP); Yosuke Honda, Tokyo (JP); Masanori Takahashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 88 days.

(21) Appl. No.: 17/859,717

(22) Filed: Jul. 7, 2022

(65) Prior Publication Data

US 2023/0010186 A1 Jan. 12, 2023

(30) Foreign Application Priority Data

Jul. 9, 2021 (JP) ..... 2021-114018

(51) Int. Cl.

| | |
|---|---|
| ***C25D 7/04*** | (2006.01) |
| ***C25D 17/06*** | (2006.01) |
| ***C25D 3/02*** | (2006.01) |
| ***C25D 5/02*** | (2006.01) |
| ***C25D 17/00*** | (2006.01) |
| ***C25D 17/08*** | (2006.01) |

(52) U.S. Cl.

CPC ..... *C25D 3/02* (2013.01); *C25D 5/02* (2013.01); *C25D 7/04* (2013.01); *C25D 17/005* (2013.01); *C25D 17/06* (2013.01); *C25D 17/08* (2013.01)

(58) Field of Classification Search

None

See application file for complete search history.

(56) References Cited

U.S. PATENT DOCUMENTS

2012/0244374 A1* 9/2012 Drollinger ..... C25D 17/08 428/603

FOREIGN PATENT DOCUMENTS

| | | |
|---|---|---|
| CN | 205711016 | 11/2016 |
| JP | 2001-335993 A | 12/2001 |

OTHER PUBLICATIONS

Office Action issued in Corresponding Taiwanese Patent Application No. 111122794, dated Mar. 17, 2023, along with an English translation thereof.

* cited by examiner

*Primary Examiner* — Wojciech Haske

(74) *Attorney, Agent, or Firm* — Greenblum & Bernstein, P.L.C.

(57) ABSTRACT

In a plating method for mounting a tubular workpiece having openings at both ends in an axial direction thereof on a power feeding clip and immersing the tubular workpiece in a circulated plating solution to plate the tubular workpiece, the mounting of the tubular workpiece on the power feeding clip is performed by inserting the power feeding clip into the tubular workpiece from one of the openings of the tubular workpiece. The power feeding clip is configured by a folded metal plate, and includes a plurality of elastic contact pieces that can elastically contact the inner surface of the tubular workpiece to hold the tubular workpiece and supply power to the tubular workpiece, and a restraining part that is located inside the tubular workpiece and restrains flow of the plating solution in the axial direction.

24 Claims, 46 Drawing Sheets

METHOD FOR PLATING OF TUBULAR WORKPIECE

TECHNICAL FIELD

The present invention relates to a method for plating of a tubular workpiece.

BACKGROUND ART

FIGS. 1A, 1B, and 2 show a configuration and an operation of an exemplary prior art of plating method, described in Japanese Patent Application Laid-Open No. 2001-335993 (hereinafter referred to as Patent Literature 1). FIGS. 1A and 1B show a state where workpieces are attached to an immersion holder, and FIG. 2 shows an operation of immersing the immersion holder in a predetermined liquid tank.

In this prior art, the workpiece is bottomed cylindrical, and a cap nut 11 is shown in FIGS. 1A, 1B and 2 as an example of the bottomed cylindrical workpiece. The immersion holder 12 includes a main shaft 13 made of metal and a plurality of support rod 14. The main shaft extends longitudinally in an ascending/descending direction, and the support rods 14 are connected to the main shaft 13 extending diagonally upward in a branch-shape and spaced from one another at predetermined intervals. The cap nuts 11 are attached to each of the support rods 14 one by one. As shown in FIG. 1B, elastic pressing parts 15 are fixed to the main shaft 13 substantially in parallel with the support rods 14, and each cap nut 11 is put on the support rod 14 and the elastic pressing part 15, whereby a large number of cap nuts 11 are held in a tree-like shape by the immersion holder 12 as shown in FIG. 1A. Thereafter, as shown in FIG. 2, the immersion holder 12 under this state is immersed in a predetermined liquid tank 16 for electrolytic plating, and after a predetermined treatment is completed, the immersion holder 12 is pulled up from the liquid tank 16 together with the treated cap nuts 11.

In Patent Literature 1, the immersion holder 12 is provided with air escape passages for allowing air trapped inside the bottomed cylindrical workpieces to escape to the outside, thereby enhancing the effectiveness and efficiency of plating the inner surfaces of the bottomed cylindrical workpieces.

As described above, the plating method for the bottomed cylindrical workpieces described in Patent Literature 1 can perform good plating on the inner surfaces as well of the workpieces. However, depending on the workpiece, there are some cases where plating on the inner surface of the workpiece is not particularly required. In such a case, if the amount of plating deposition on the inner surface of each workpiece can be reduced, a proportional amount of a plating material can be saved, so that the cost can be reduced.

BRIEF SUMMARY OF THE INVENTION

In view of these points, an object of the present invention is to provide, particularly for a tubular workpiece, a plating method capable of reducing the amount of plating deposition inside a workpiece.

The technical matters described herein are not intended to expressly or implicitly limit the invention described in the claims, and further, and are not an expression of the possibility of accepting such a limitation imposed by persons other than those who benefit from the present invention (for example, the applicant and right holders), but they are merely described for the sake of easy understanding of the gist of the present invention. The outline of the present invention from another point of view can be understood from, for example, the scope of claims at the time of filing of this patent application.

A plating method of the present invention is a wet plating method for a rigid pipe (also referred to as a tubular workpiece in the present specification). The wet plating method is a method of plating a processing target object in a solution in which metal is dissolved. Both ends in the axial direction of the pipe are opened. Despite the term "pipe," the length of the pipe is not always sufficiently long as compared with the width of the pipe. Examples of the pipe include, but are not limited to, oval-shaped metal shells of USB (universal serial bus) Type-C (that is, metal portions to be used to connect connectors). Of course, the metal shell is plated before it is incorporated into a finished USB Type-C.

Prior to the plating processing, the pipe is mounted on a power feeding clip. The power feeding clip has a shape obtained by bending a metal plate. The power feeding clip has, as a part thereof, a baffle (also referred to as a restraining part in the present specification) located inside the pipe in a state where the pipe is mounted on the power feeding clip. The pipe mounted on the power feeding clip is plated in a solution in which metal is dissolved. The baffle impedes the flow of the plating solution that passes through in the axial direction of the pipe in the plating processing.

Effects of the Invention

According to the present invention, it is possible to reduce the amount of plating deposition inside a tubular workpiece, and therefore it is possible to save a proportional amount of a plating material.

LIST OF REFERENCE NUMERALS

Figure 1A:
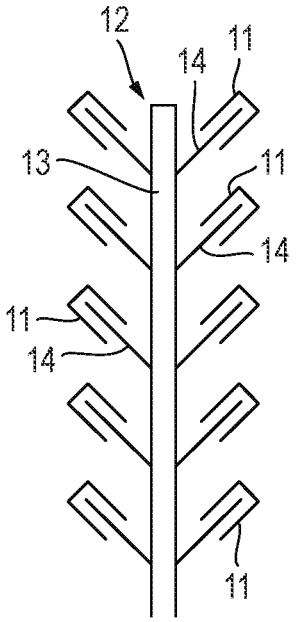
FIG. 1A (PRIOR ART)
FIG. 1A is a diagram showing an attachment state of workpieces in a conventional example of a plating method.
Figure 1B:
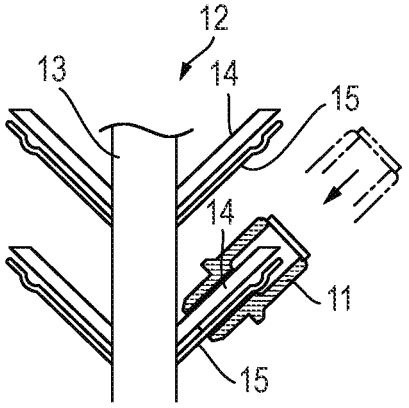
FIG. 1B (PRIOR ART)
FIG. 1B is a diagram showing attachment of the workpieces in the conventional example of the plating method.
Figure 2:
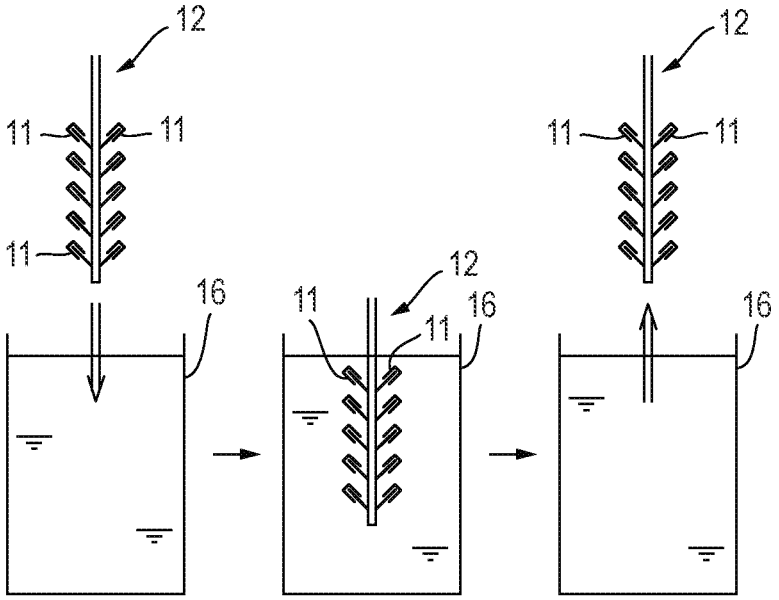
FIG. 2 (PRIOR ART)
FIG. 2 is a diagram showing an operation of immersing an immersion holder shown in FIG. 1A in a liquid tank.

11 cap nut
12 immersion holder
13 main shaft
14 support rod
15 elastic pressing part
16 liquid tank
20 power feeding clip
20' power feeding clip
20" power feeding clip
21 elastic contact piece
22 elastic contact piece
21*a* contact part
22*a* contact part
22*b* edge part
22*c* edge part
23 notch
24 restraining part
30 tubular workpiece
30' tubular workpiece
30" tubular workpiece
50 power feeding clip
50' power feeding clip
50" power feeding clip
51 restraining part
52 elastic contact piece
53 elastic contact piece
54 elastic contact piece
52*a* contact part
53*a* contact part
54*a* contact part
55 plate part
100 carrier
101 pilot hole
102 pilot hole
200 reels
300 reel

DETAILED DESCRIPTION

Embodiments of the present invention will be described with reference to the drawings.

Figure 3A:
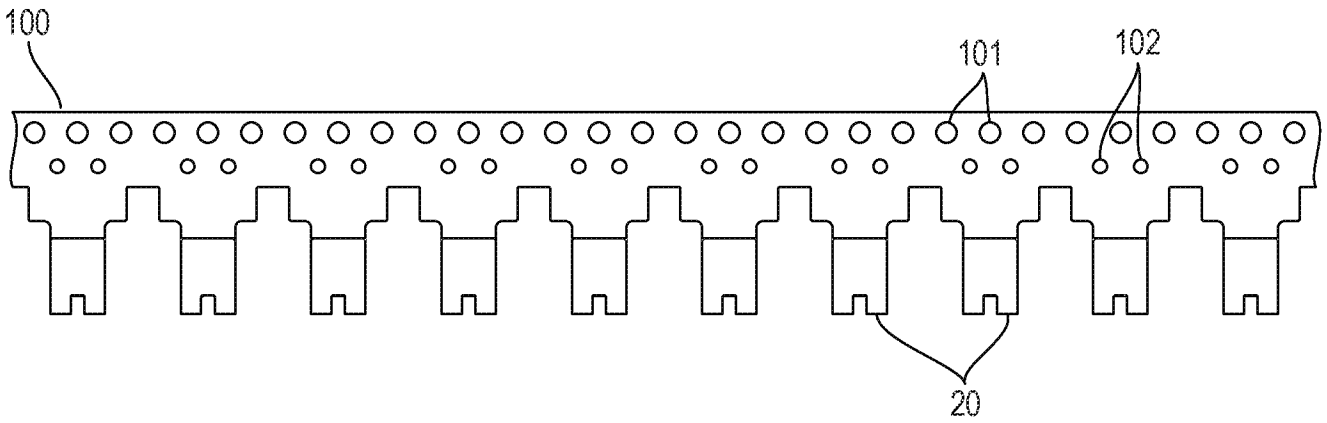
FIG. 3A is a front view showing a carrier used in an embodiment.

FIG. 3A shows a carrier to be used in an embodiment of a method for plating a tubular workpiece according to the present invention. A carrier 100 is a long member, and only a part thereof is shown in FIG. 3A. A large number of power feeding clips 20 to mount] tubular workpieces on are formed integrally with the carrier 100 so as to be arranged in a row at a predetermined pitch. The carrier 100 is formed by cutting a single metal plate such as a stainless-steel plate in a predetermined shape and performing a bending work. In FIG. 3A, reference numerals 101 and 102 designate pilot holes.

Figure 4A:
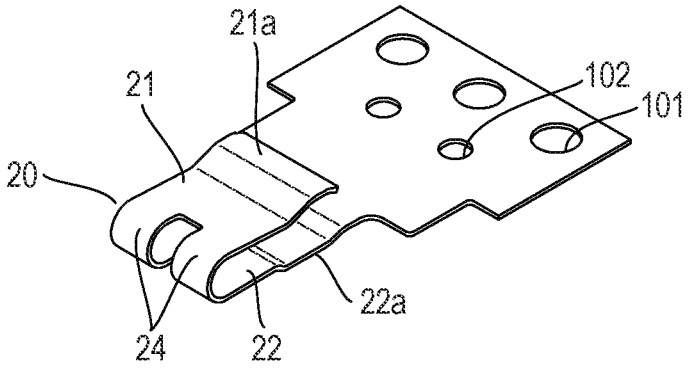
FIG. 4A is an enlarged perspective view of a portion of the carrier shown in FIG. 3A where one power feeding clip is located.
Figure 4B:
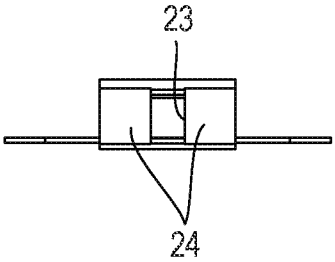
FIG. 4B is a front view of the portion shown in FIG. 4A.
Figure 4C:
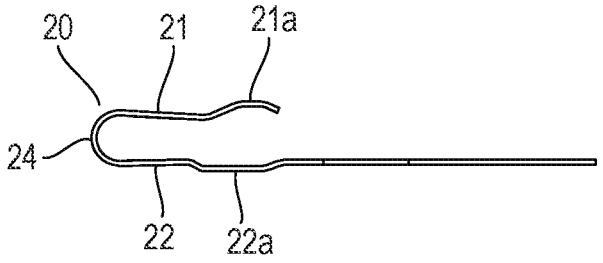
FIG. 4C is a side view of the portion shown in FIG. 4A.

FIGS. 4A, 4B, and 4C show a partially enlarged portion of the carrier 100 at which one power feeding clip 20 is located. In this example, the power feeding clip 20 is folded in a U-shape, and portions corresponding to both legs of the U-shape function as elastic contact pieces 21 and 22, respectively. The two elastic contact pieces 21 and 22 include contact parts 21*a* and 22*a* which are bent so as to protrude in an outward direction away from each other, respectively. In this example, a notch 23 is provided at a portion corresponding to a middle part of the U-shape as shown in FIGS. 4A, 4B, and 4C, and the middle part of the U-shape functions as a restraining part 24 for suppressing flow of a plating solution as described later.

Figure 3B:
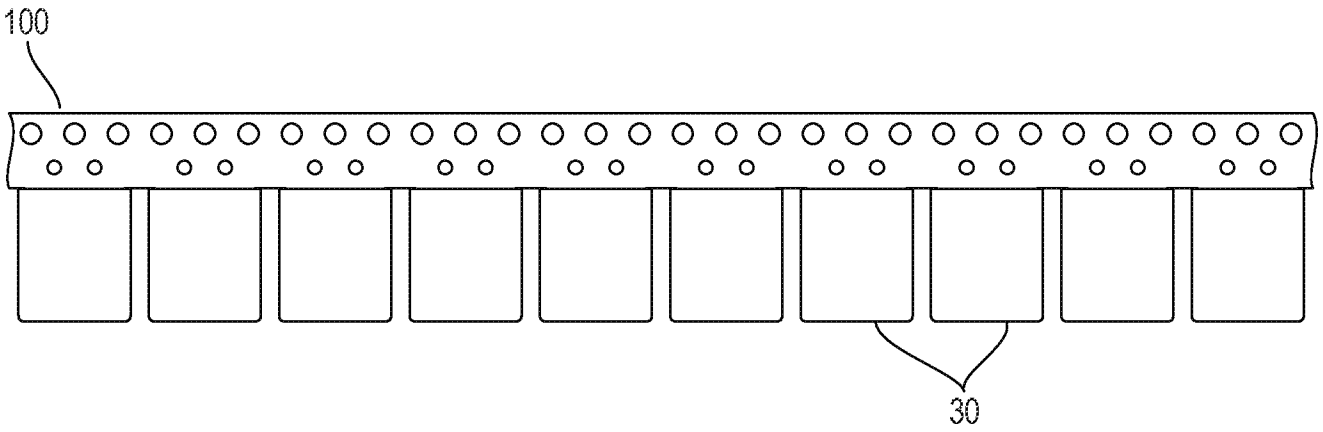
FIG. 3B is a front view showing a state in which tubular workpieces are attached to the carrier shown in FIG. 3A.

Plating on the tubular workpieces is performed by mounting the tubular workpieces on the respective power feeding clips 20 of the carrier 100 and immersing them in a circulated plating solution. FIG. 3B shows a state in which the tubular workpieces 30 are mounted on the respective power feeding clips 20. In this example, each of the tubular workpieces 30 is a stainless-steel shell to serve as a component of a connector, and Ni-plating is performed on this shell.

Figure 5A:
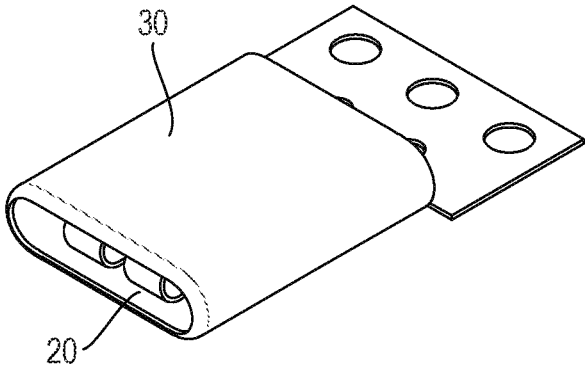
FIG. 5A is a perspective view showing a state in which a tubular workpiece is attached to a first example of the power feeding clip shown in FIG. 4A.
Figure 5B:
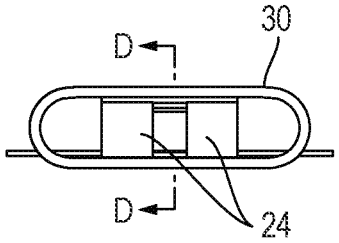
FIG. 5B is a front view of the state in which the tubular workpiece is attached to the first example of the power feeding clip shown in FIG. 4A.
Figure 5C:
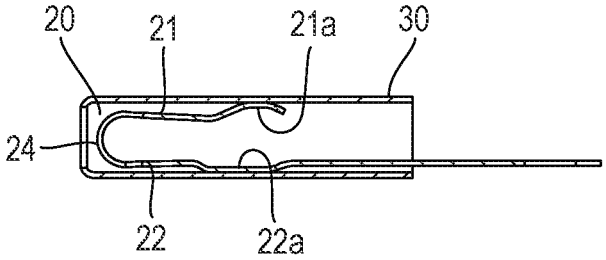
FIG. 5C is a cross-sectional view taken along line D-D of FIG. 5B.

The mounting of the tubular workpiece 30 on the power feeding clip 20 is performed by inserting the power feeding clip 20 into the tubular workpiece 30 from one of the openings it has at both ends in its axial direction. As a result, the two elastic contact pieces 21 and 22 of the power feeding clip 20 hold the tubular workpiece 30 and become capable of feeding power to the tubular workpiece 30 by spreading outward and elastically coming into contact with the two opposing inner surfaces of the tubular workpiece 30 as shown in FIGS. 5A, 5B and 5C. Since the two elastic contact pieces 21 and 22 are provided with the contact parts 21*a* and 22*a* which protrude in an outward direction away from each other, their stable and excellent contact with the inner surface of the tubular workpiece 30 can be achieved by the contact parts 21*a* and 22*a*.

Necessary feeding and ascending/descending operations on the carrier 100 are performed by a drive device (not shown), and the carrier 100 at least sequentially undergoes a mounting step of mounting tubular workpieces 30 on respective power feeding clips 20 as described above, a plating step of passing the tubular workpieces 30 mounted on the power feeding clips 20 through a plating tank in which a plating solution is stored, and a retrieving step of detaching the plated tubular workpieces 30 from the power feeding clips 20. A carrier 100 as such makes it possible to perform sequential plating on the tubular workpieces 30 in this example.

In the plating step, a power supply is connected to the carrier 100 and to an anode provided in the plating tank so that the power feeding clips 20 can feed power to the tubular workpieces 30, and plating is performed by applying a positive voltage to the anode while applying a negative voltage to the carrier 100. The tubular workpiece 30 is immersed in the circulated plating solution while the axial direction of each tubular workpiece 30 is set to, for example, an up-and-down direction. Here, as shown in FIG. 5B, the restraining part 24 of the power feeding clip 20 inserted in the tubular workpiece 30 is located inside the tubular workpiece 30 so as to block its passageway to some extent, so that the flow of the plating solution in the axial direction is restrained by the restraining part 24. As a result, in this example, the amount of plating deposition inside the tubular workpiece 30 is reduced.

As described above, in the plating step, in order to reduce the amount of plating deposition inside the tubular workpiece 30, the tubular workpiece 30 is plated under the condition that the flow of the plating solution inside the tubular workpiece 30 is restrained by the restraining part 24 of the power feeding clip 20, which makes it possible to save the amount of a plating material in this example.

The amount of plating material deposition on the inner surface of the tubular workpiece 30 can be reduced, specifically, even though the inner surface of the tubular workpiece 30 is plated, the plating thickness on the inner surface can be reduced. As a result of that, the variation in the plating thickness becomes smaller as compared with a case where the plating thickness is larger (i.e., thicker). It follows that it is possible to reduce the variation in the internal dimension of the tubular workpieces 30 among those after plating. This makes it possible to satisfactorily perform an assembly work of, for example, inserting components into the tubular workpiece 30 in a subsequent assembly process, etc.

The restraining part 24 of the power feeding clip 20 is sized to occupy, viewed in the axial direction of the tubular workpiece 30, an area which is not less than 30% and not more than 90% of the area of one of the two openings of the tubular workpiece 30.

The carrier 100 on which the tubular workpieces 30 are not mounted yet may be in a state of, for example, being wound around a reel, and after the carrier 100 is unreeled from the reel, the tubular workpieces 30 are mounted on the respective power feeding clips 20 of the carrier 100 and subsequently the predetermined plating step is performed.

Figure 6A:
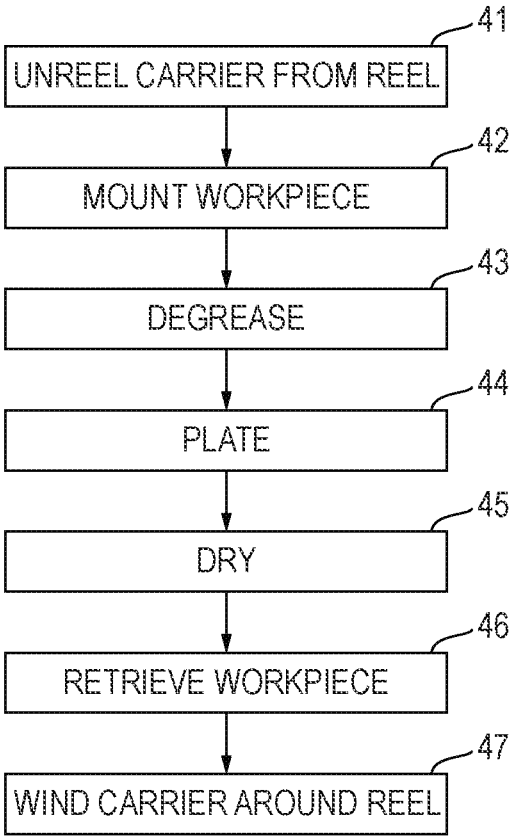
FIG. 6A is a process diagram of an embodiment.

FIG. 6A shows a process in such a case by using steps 41 to 47 in order. The steps 41 to 47 successively perform unreeling a carrier from a reel, mounting workpieces, degreasing, plating, drying, retrieving the workpieces, and winding the carrier around the reel. These steps 41 to 47 are a so-called reel-to-reel plating process. It is also possible to use automatic machines to mount the workpieces in step 42 and retrieve the workpieces in step 46.

In the process shown in FIG. 6A, the carrier from which the workpieces have been detached is wound around the reel in the final step 47. However, as in steps 41 to 45 and 48 shown in FIG. 6B, the carrier in a state where the workpieces are still attached thereto may be wound around the reel in the final step 48 without detaching the workpieces from the carrier. This process is suitable for a case where the plated tubular workpieces 30 are assembled by an automatic machine into a product to incorporate them.

Figure 6B:
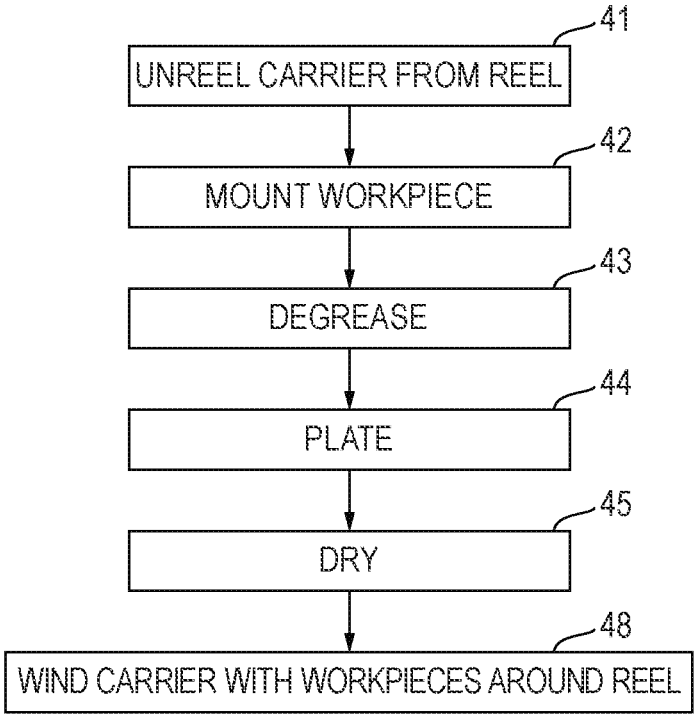
FIG. 6B is a process diagram of another embodiment.
Figure 7A:
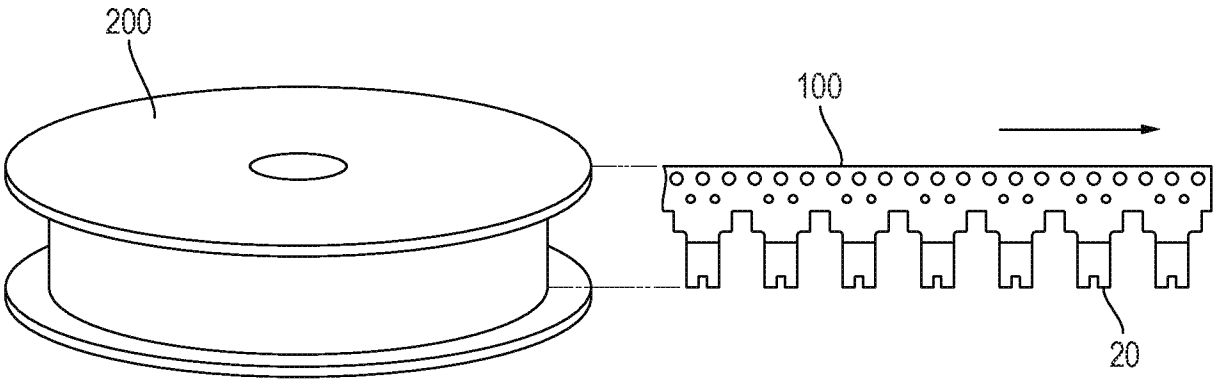
FIG. 7A is a schematic diagram showing "unreeling a carrier from a reel" in the process shown in FIG. 6A or FIG. 6B.
Figure 7B:
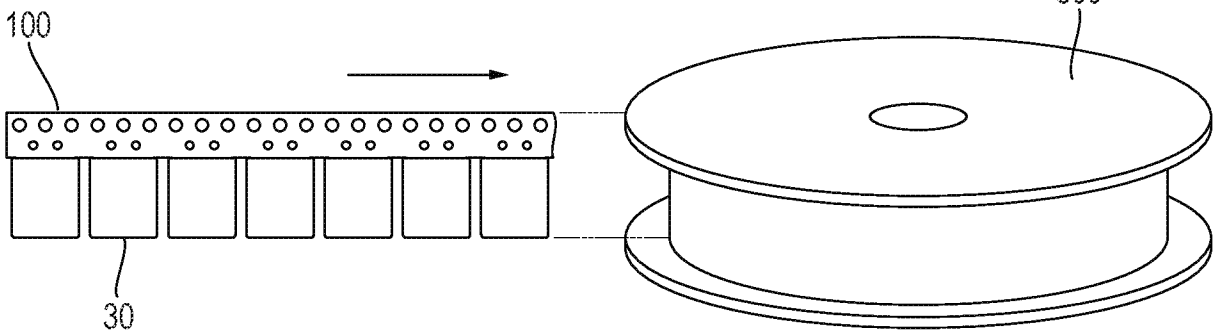
FIG. 7B is a schematic diagram showing "winding a carrier with workpieces around a reel" in the process shown in FIG. 6B.

FIG. 7A depicts the carrier being unreeled from a reel in step 41 shown in FIGS. 6A and 6B, and reference numeral 200 in FIG. 7A designates a reel. Further, FIG. 7B depicts the carrier with workpieces being wound around a reel in step 48 shown in FIG. 6B, and reference numeral 300 in FIG. 7B designates a reel.

Figure 8:
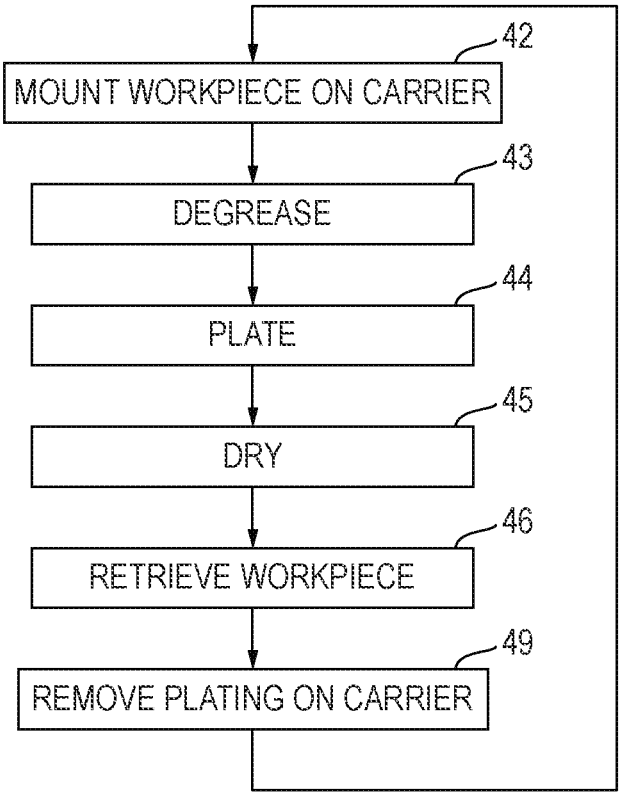
FIG. 8 is a process diagram of yet another embodiment.

The carrier 100 may be formed in an endless closed loop so that continuous plating can be performed while the carrier 100 moves in a circle. FIG. 8 shows a process in this case by using steps 42 to 46 and 49 in order. In this example, after the workpieces are retrieved in step 46, the plating deposited on the carrier is removed in step 49, and after this step 49, the process returns to step 42 to mount workpieces on the carrier again. The carrier 100 moves in a circle in this way, and repeatedly undergoes steps 42 to 46, 49.

The removal of the plating deposited on the carrier 100 in step 49 may be performed, for example, by immersing the carrier 100 in an electrolytic solution and causing an electrochemical reaction inverse to that of plating. The plating material removed from the carrier 100 is reused.

As the amount of plating deposition inside the tubular workpiece 30 is reduced by the restraining part 24 of the power feeding clip 20 as described above, the plating material also deposit less on the power feeding clip 20 in there. A recovery work for the plating material deposited on the carrier 100 may also be performed, for example, in the process shown in FIG. 6A in order to save the plating material. However, since the amount of plating deposition is reduced, the recovery work comprising removing the deposits from the carrier 100 to recover the plating material may be performed only after undergoing the plating step several times repeatedly, for example, and in this way, the recovery cost can be reduced.

The shape of each power feeding clip provided on the carrier 100 is not limited to the shape shown in FIGS. 4A, 4B, and 4C, but other shapes may be adopted. FIGS. 9A, 9B, 9C, 11A, 11B, 11C, 13A, 13B, 13C, 15A, 15B, 15C, 17A, 17B, and 17C show other examples of the shape of the power feeding clip, and FIGS. 10A, 10B, 10C, 12A, 12B, 12C, 14A, 14B, 14C, 16A, 16B, 16C, 18A, 18B, and 18C show states where a tubular workpiece is mounted on each of power feeding clips shown in FIGS. 9A, 9B, 9C, 11A, 11B, 11C, 13A, 13B, 13C, 15A, 15B, 15C, 17A, 17B, and 17C, respectively.

Figure 9A:
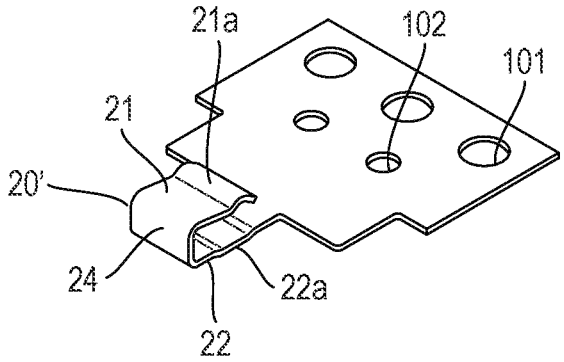
FIG. 9A is a perspective view showing a second example of the power feeding clip.
Figure 9B:
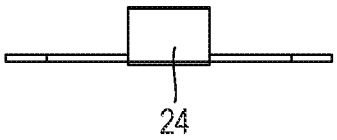
FIG. 9B is a front view of the power feeding clip shown in FIG. 9A.
Figure 9C:
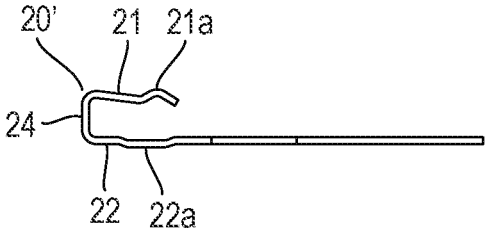
FIG. 9C is a side view of the power feeding clip shown in FIG. 9A.
Figure 10A:
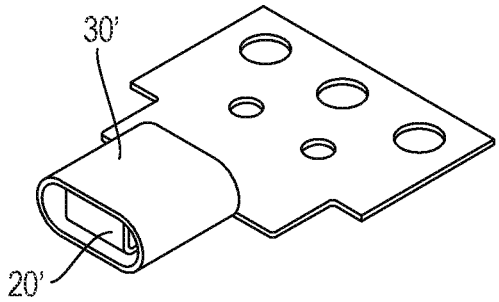
FIG. 10A is a perspective view showing a state in which a tubular workpiece is attached to the second example of the power feeding clip shown in FIG. 9A.
Figure 10B:
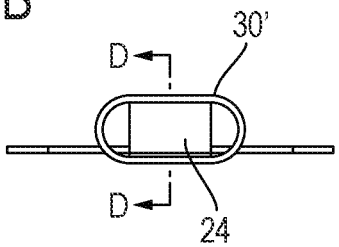
FIG. 10B is a front view of the state in which the tubular workpiece is attached to the second example of the power feeding clip shown in FIG. 9A.
Figure 10C:
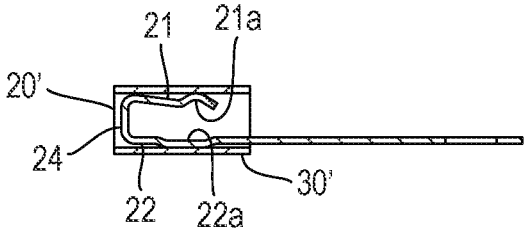
FIG. 10C is a cross-sectional view taken along line D-D of FIG. 10B.

A power feeding clip 20' shown in FIGS. 9A, 9B, and 9C is shaped to be folded in angular U-shape, and portions corresponding to those of the power feeding clip 20 shown in FIGS. 4A, 4B, 4C are designated by the same reference numerals. In this example, no notch is provided at the middle part of the angular U-shape which forms the restraining part 24, and two elastic contact pieces 21 and 22 are formed by both leg parts of the angular U-shape.

Figure 11A:
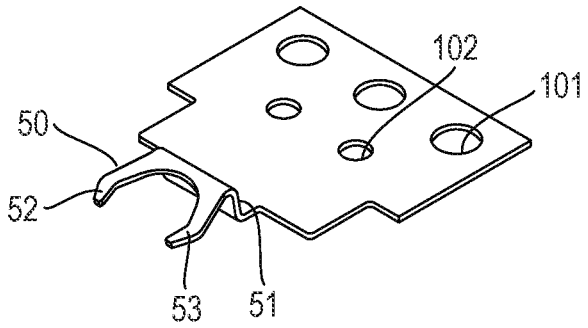
FIG. 11A is a perspective view showing a third example of the power feeding clip.
Figure 11B:
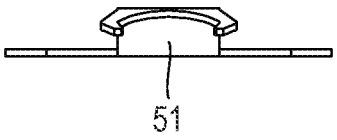
FIG. 11B is a front view of the power feeding clip shown in FIG. 11A.
Figure 11C:
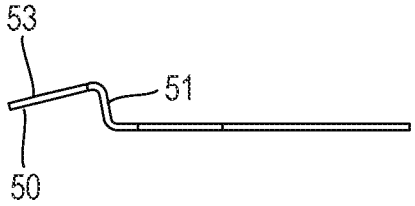
FIG. 11C is a side view of the power feeding clip shown in FIG. 11A.
Figure 12A:
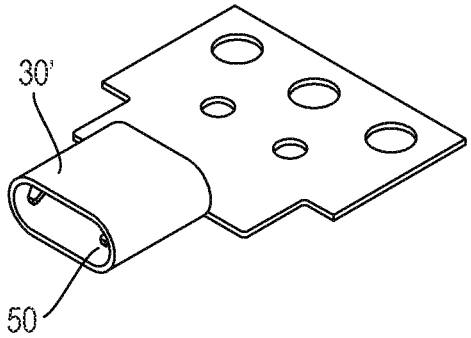
FIG. 12A is a perspective view showing a state in which a tubular workpiece is attached to the third example of the power feeding clip shown in FIG. 11A.
Figure 12B:
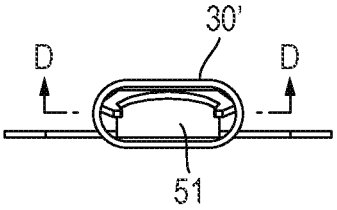
FIG. 12B is a front view showing the state in which the tubular workpiece is attached to the third example of the power feeding clip shown in FIG. 11A.
Figure 12C:
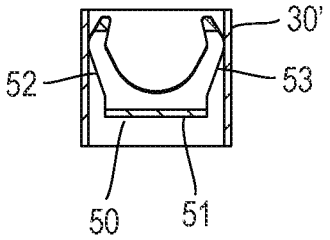
FIG. 12C is a cross-sectional view taken along line D-D of FIG. 12B.

A power feeding clip 50 shown in FIGS. 11A, 11B, and 11C comprises a restraining part 51 and two elastic contact pieces 52, 53. The restraining part 51 is formed by a flat plate part which intersects the axial direction of a tubular workpiece 30' when inserted into the tubular workpiece 30', and the two elastic contact pieces 52 and 53 are formed in a portion bent and extended from one side of the flat plate part, extending in the insertion direction to the tubular workpiece 30'.

Figure 13A:
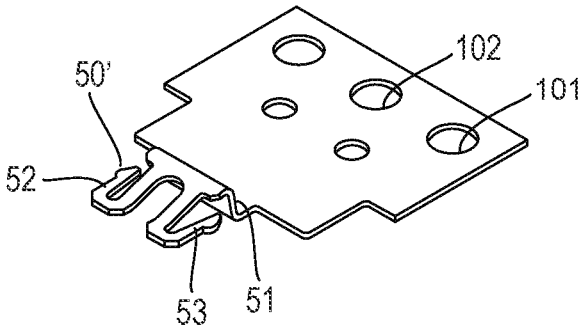
FIG. 13A is a perspective view showing a fourth example of the power feeding clip.
Figure 13B:
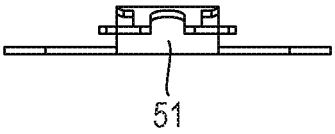
FIG. 13B is a front view of the power feeding clip shown in FIG. 13A.
Figure 13C:
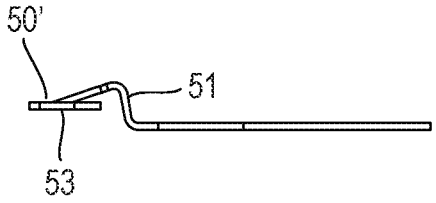
FIG. 13C is a side view of the power feeding clip shown in FIG. 13A.
Figure 14A:
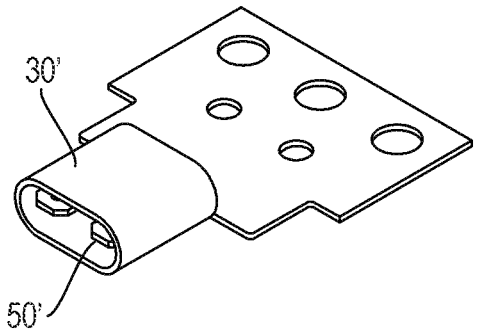
FIG. 14A is a perspective view showing a state in which a tubular workpiece is attached to the fourth example of the power feeding clip shown in FIG. 13A.
Figure 14B:
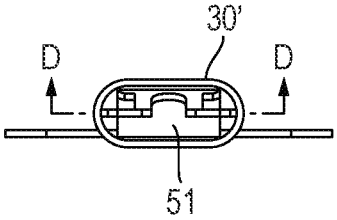
FIG. 14B is a front view of the state in which the tubular workpiece is attached to the fourth example of the power feeding clip shown in FIG. 13A.
Figure 14C:
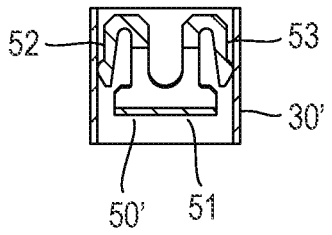
FIG. 14C is a cross-sectional view taken along line D-D of FIG. 14B.

Similar to the power feeding clip 50 shown in FIGS. 11A, 11B, and 11C, a power feeding clip 50' shown in FIGS. 13A, 13B, and 13C comprises a restraining part 51 formed by a flat plate part and two elastic contact pieces 52 and 53 provided in a portion bent and extended from one side of the flat plate part. However, as shown in FIG. 13, the two elastic contact pieces 52 and 53 of this power feeding clip 50' have a shape firstly extending in the insertion direction to the tubular workpiece, secondly bent in an outward direction away from each other, and then thirdly folded back to the restraining part 51.

Figure 15A:
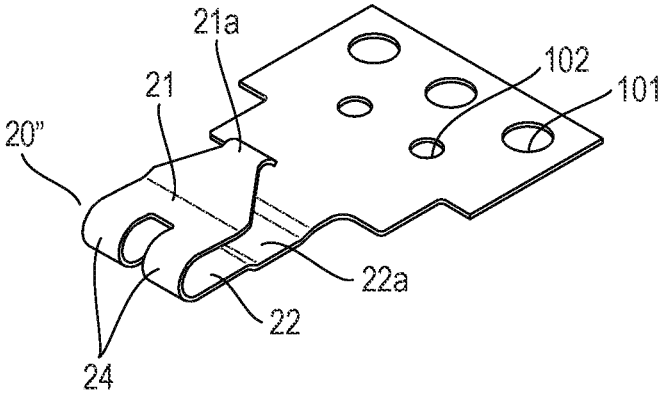
FIG. 15A is a perspective view showing a fifth example of the power feeding clip.
Figure 15B:
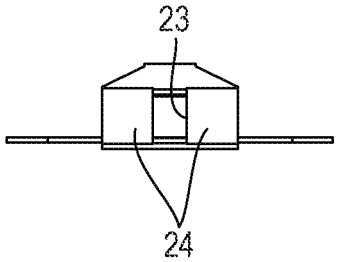
FIG. 15B is a front view of the power feeding clip shown in FIG. 15A.
Figure 15C:
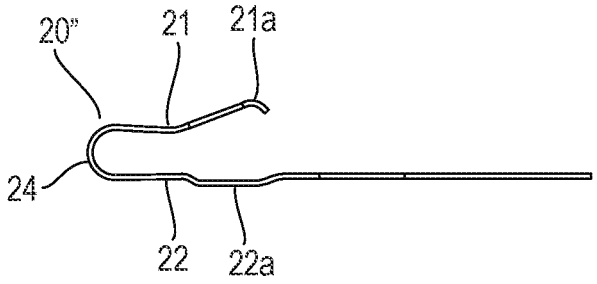
FIG. 15C is a side view of the power feeding clip shown in FIG. 15A.

Similar to the power feeding clip 20 shown in FIGS. 4A, 4B and 4C, a power feeding clip 20" shown in FIGS. 15A, 15B and 15C is shaped to be folded in U-shape, and two elastic contact pieces 21 and 22 are formed in both leg parts of the U-shape. However, one elastic contact piece 21 has a portion extending to its tip (free end) which is gradually narrowed forming a trapezoidal shape. The portion forming the trapezoidal shape is slightly raised (bent up) in a direction away from the other elastic contact piece 22, and a contact part 21*a* is formed at the tip thereof.

Figure 16A:
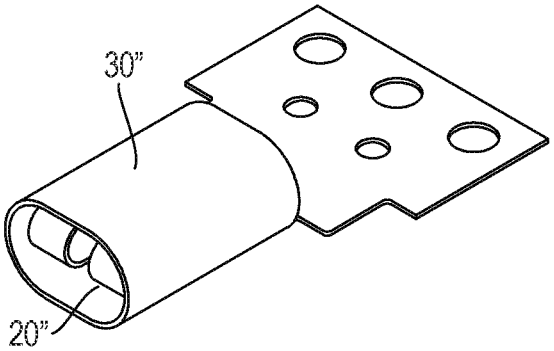
FIG. 16A is a perspective view showing a state in which a tubular workpiece is attached to the fifth example of the power feeding clip shown in FIG. 15A.
Figure 16B:
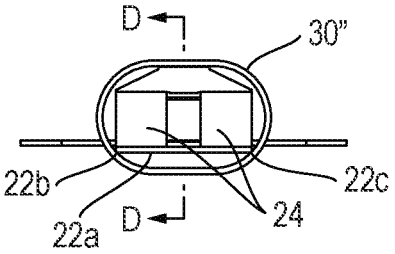
FIG. 16B is a front view of the state in which the tubular workpiece is attached to the fifth example of the power feeding clip shown in FIG. 15A.
Figure 16C:
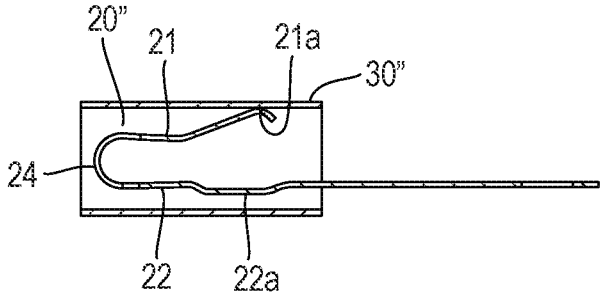
FIG. 16C is a cross-sectional view taken along line D-D of FIG. 16B.

Similar to the power feeding clip 20 shown in FIGS. 4A, 4B, and 4C, a contact part 22*a* is formed at the other elastic contact piece 22. However, the power feeding clip 20" is configured so that the contact part 21*a* and edge parts 22*b* and 22*c* at both ends in the width direction of the contact part 22*a* come into contact with the inner surface of the tubular workpiece 30" when inserted into the tubular workpiece 30" as shown in FIGS. 16B and 16C. A notch 23 is provided to the restraining part 24 like the power feeding clip 20.

Figure 17A:
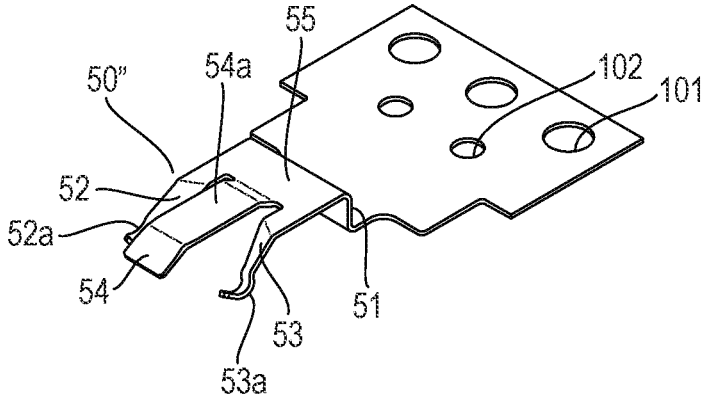
FIG. 17A is a perspective view showing a sixth example of the power feeding clip.
Figure 17B:
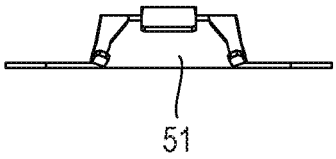
FIG. 17B is a front view of the power feeding clip shown in FIG. 17A.
Figure 17C:
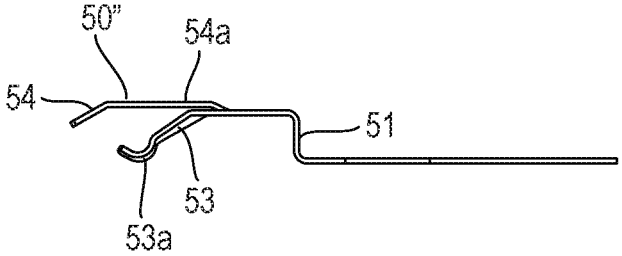
FIG. 17C is a side view of the power feeding clip shown in FIG. 17A.

Similar to the power feeding clip 50 shown in FIGS. 11A, 11B, and 11C, a power feeding clip 50" shown in FIGS. 17A, 17B, and 17C comprises a restraining part 51 formed in a flat plate part and two elastic contact pieces 52, 53. Further, the power feeding clip 50" comprises another elastic contact piece 54 as the third one. The elastic contact piece 54 extends between the elastic contact pieces 52 and 53 in a way similar to the elastic contact pieces 52 and 53, and has a bent shape in which the middle part thereof is positioned slightly higher than the plate surface of a plate part 55 that is bent and extended from one side of the restraining part 51. This middle part functions as a contact part 54*a*. In the power feeding clip 50" as such, three of the elastic contact pieces 52, 53 and 54 are all formed in a portion that is bent and extended from one side of the restraining part 51.

On the other hand, the elastic contact pieces 52 and 53 extend diagonally downward from the plate part 55 as shown in FIGS. 17A, 17B and 17C, and contact parts 52*a* and 53*a* are formed at the tips of the elastic contact pieces 52 and 53 respectively by bending them in an arc shape.

Figure 18A:
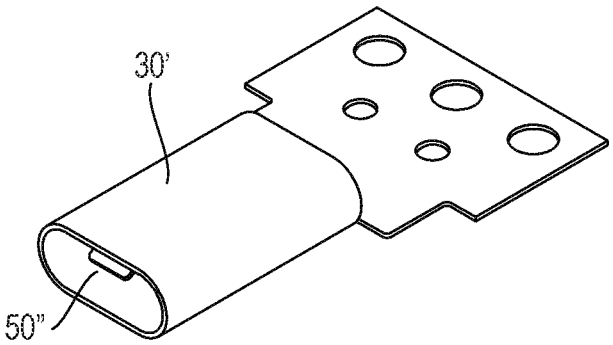
FIG. 18A is a perspective view showing a state in which a tubular workpiece is attached to the sixth example of the power feeding clip shown in FIG. 17A.
Figure 18B:
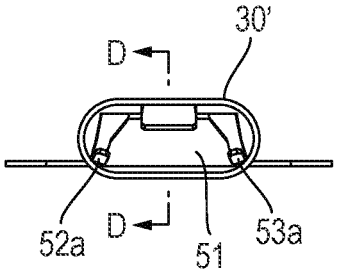
FIG. 18B is a front view showing the state in which the tubular workpiece is attached to the sixth example of the power feeding clip shown in FIG. 17A.
Figure 18C:
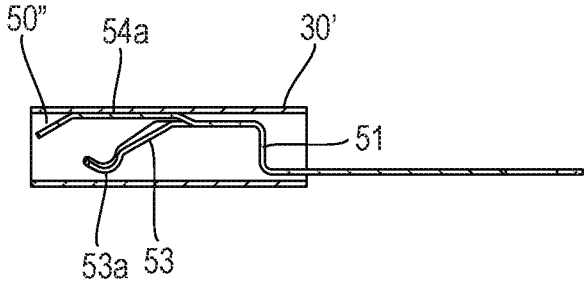
FIG. 18C is a sectional view taken along line D-D of FIG. 18B.

The power feeding clip 50" is configured so that the contact parts 52*a*, 53*a* and 54*a* come into contact with the inner surface of the tubular workpiece 30' as shown in FIGS. 18B and 18C when inserted into the tubular workpiece 30'.

Abovementioned other examples of the shape of the power feeding clip have been described so far. In each of these power feeding clips 20', 50, 50', 20", 50", as shown in FIGS. 10A, 10B, 10C, 12A, 12B, 12C, 14A, 14B, 14C, 16A, 16B, 16C, 18A, 18B, and 18C, a plurality of elastic contact pieces are capable of both elastically contacting the inner surface of the tubular workpiece to hold the tubular workpiece and supplying power to the tubular workpiece, while the restraining part is capable of restraining the flow of the plating solution inside the tubular workpiece.

What is claimed is:

1. A method for plating of a tubular workpiece having openings at both ends in an axial direction thereof, comprising the steps of:

providing a power feeding clip made of a folded metal plate, the power feeding clip having a plurality of elastic contact pieces and a restraining part, the plurality of elastic contact pieces being configured to both hold the tubular workpiece and feed power thereto by elastically contacting an inner surface of the tubular workpiece, the restraining part being configured to restrain flow of a plating solution along the axial direction by being located inside the tubular workpiece;

mounting the tubular workpiece on the power feeding clip, wherein the power feeding clip is inserted into the tubular workpiece from one of the openings of the tubular workpiece; and plating the tubular workpiece by immersing the tubular workpiece in the plating solution as the plating solution is circulating and feeding power to the tubular workpiece by the power feeding clip while restraining the flow of the plating solution inside the tubular workpiece by the restraining part located inside the tubular workpiece.

2. The method according to claim 1, wherein the plurality of elastic contact pieces comprises two elastic contact pieces, the power feeding clip is shaped to be folded in a U-shape, the restraining part is formed by a middle part of the U-shape, and the two elastic contact pieces are formed by both leg parts of the U-shape.

3. The method according to claim 1, wherein the plurality of elastic contact pieces comprises two elastic contact pieces, the power feeding clip is shaped to be folded in an angular U-shape, the restraining part is formed by a middle part of the angular U-shape, and the two elastic contact pieces are formed by both leg parts of the angular U-shape.

4. The method according to claim 1, wherein the restraining part is formed by a flat plate part intersecting the axial direction, and the plurality of elastic contact pieces are provided in a portion which is bent and extended from one side of the flat plate part.

5. The method according to claim 1, wherein the restraining part is sized to occupy, viewed in the axial direction of the tubular workpiece 30, an area which is not less than 30% and not more than 90% of an area of one of the openings.

6. The method according to claim 2, wherein the restraining part is sized to occupy, viewed in the axial direction of the tubular workpiece 30, an area which is not less than 30% and not more than 90% of an area of one of the openings.

7. The method according to claim 3, wherein the restraining part is sized to occupy, viewed in the axial direction of the tubular workpiece 30, an area which is not less than 30% and not more than 90% of an area of one of the openings.

8. The method according to claim 4, wherein the restraining part is sized to occupy, viewed in the axial direction of the tubular workpiece 30, an area which is not less than 30% and not more than 90% of an area of one of the openings.

9. The method according to claim 1, wherein said step of providing the power feeding clip further comprises providing a carrier having a plurality of the power feeding clips arranged thereon; said step of mounting the tubular workpiece further comprises mounting the plurality of the tubular workpieces on the plurality of the power feeding clips that the carrier has; said step of plating the tubular workpiece further comprises passing the carrier having the plurality of the tubular workpieces mounted on the the plurality of power feeding clips through a plating tank in which the plating solution is stored and circulating; and the method further comprises a step of retrieving the tubular workpiece, after said step of plating the tubular workpiece, by detaching the plurality of the tubular workpieces from the plurality of the power feeding clips.

10. The method according to claim 9, wherein in association with each of the plurality of the power feeding clips which the carrier has, the plurality of elastic contact pieces comprises two elastic contact pieces, the power feeding clip is shaped to be folded in a U-shape, the restraining part is formed by a middle part of the U-shape, and the two elastic contact pieces are formed by both leg parts of the U-shape.

11. The method according to claim 9, wherein in association with each of the plurality of the power feeding clips which the carrier has, the plurality of elastic contact pieces comprises two elastic contact pieces, the power feeding clip is shaped to be folded in an angular U-shape, the restraining part is formed by a middle part of the angular U-shape, and the two elastic contact pieces are formed by both leg parts of the angular U-shape.

12. The method according to claim 9, wherein in association with each of the plurality of the power feeding clips which the carrier has, the restraining part is formed by a flat plate part intersecting the axial direction, and the plurality of elastic contact pieces are provided in a portion which is bent and extended from one side of the flat plate part.

13. The method according to claim 9, wherein in association with each of the plurality of the power feeding clips which the carrier has, the restraining part is sized to occupy, viewed in the axial direction of the tubular workpiece 30, an area which is not less than 30% and not more than 90% of an area of one of the openings.

14. The method according to claim 10, wherein in association with each of the plurality of the power feeding clips which the carrier has, the restraining part is sized to occupy, viewed in the axial direction of the tubular workpiece 30, an area which is not less than 30% and not more than 90% of an area of one of the openings.

15. The method according to claim 11, wherein in association with each of the plurality of the power feeding clips which the carrier has, the restraining part is sized to occupy, viewed in the axial direction of the tubular workpiece 30, an area which is not less than 30% and not more than 90% of an area of one of the openings.

16. The method according to claim 12, in association with each of the plurality of the power feeding clips which the carrier has, the restraining part is sized to occupy, viewed in the axial direction of the tubular workpiece 30, an area which is not less than 30% and not more than 90% of an area of one of the openings.

17. The method according to claim 9, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

18. The method according to claim 10, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

19. The method according to claim 11, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

20. The method according to claim 12, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

21. The method according to claim 13, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

22. The method according to claim 14, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

23. The method according to claim 15, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

24. The method according to claim 16, wherein the carrier is formed in an endless closed loop; the method further comprises a step of removing a plating deposited on the carrier, after said step of retrieving the tubular workpiece; and after said step of removing plating on the carrier, the method returns to said step of mounting the tubular workpiece by moving the carrier in a circle, whereby a continuous plating is performed cyclically.

* * * * *